US009487312B2

(12) United States Patent
Bianco et al.

(10) Patent No.: US 9,487,312 B2
(45) Date of Patent: Nov. 8, 2016

(54) SCREWING ASSEMBLY FOR SCREWING CLOSING PLUGS ONTO SYRINGES

(71) Applicants: Walter Bianco, Trieste (IT); Paolo Giribona, Trieste (IT); Enrico Merlani, Trieste (IT)

(72) Inventors: Walter Bianco, Trieste (IT); Paolo Giribona, Trieste (IT); Michele Minisini, Trieste (IT); Enrico Merlani, Trieste (IT)

( * ) Notice: Subject to any disclaimer, the term of this patent is extended or adjusted under 35 U.S.C. 154(b) by 589 days.

(21) Appl. No.: 13/760,473

(22) Filed: Feb. 6, 2013

(65) Prior Publication Data

US 2013/0145725 A1 Jun. 13, 2013

Related U.S. Application Data

(63) Continuation of application No. 13/530,160, filed on Jun. 22, 2012, now abandoned.

(51) Int. Cl.

| | |
|---|---|
| ***B65B 3/02*** | (2006.01) |
| ***B65B 7/28*** | (2006.01) |
| *B65B 3/00* | (2006.01) |

(52) U.S. Cl.

CPC ..... *B65B 3/02* (2013.01); *B65B 7/2807* (2013.01); *B65B 7/2835* (2013.01); *B65B 3/003* (2013.01)

(58) Field of Classification Search

CPC ..... B67B 1/005; B67B 1/06; B65B 7/161; B65B 7/2807; B65B 7/2828

USPC ..... 53/305, 306, 309, 310, 311

See application file for complete search history.

(56) References Cited

U.S. PATENT DOCUMENTS 1,446,686 A * 2/1923 Bateman ..... B67B 3/2053 221/301
1,748,961 A * 3/1930 Risser ..... B67B 3/2033 53/304
1,775,255 A * 9/1930 Risser ..... B67B 3/2033 53/306
2,015,913 A * 10/1935 Von Sydow ..... B67B 3/22 221/293
2,823,500 A * 2/1958 Brown ..... B65B 3/006 141/263
2,826,885 A * 3/1958 Henderson ..... B67B 1/005 53/306
2,841,940 A * 7/1958 Brown ..... B65B 3/006 53/311
3,029,918 A * 4/1962 Stover ..... B65B 35/56 193/46
3,487,622 A * 1/1970 Mueller ..... B65B 7/2842 53/282
5,115,617 A * 5/1992 Lewis ..... B65B 7/2835 53/306

(Continued)

FOREIGN PATENT DOCUMENTS

WO WO 98/33705 8/1998

OTHER PUBLICATIONS

Italian Search Report dated Mar. 27, 2012 from Italian Application No. BO2011A 000359.
U.S. Appl. No. 13/530,160, filed Jun. 22, 2012.

*Primary Examiner* — Hemant M Desai
*Assistant Examiner* — Tanzim Imam
(74) *Attorney, Agent, or Firm* — McCarter & English, LLP

(57) ABSTRACT

A closing plug is screwed onto the threaded open end of a syringe by a screwing assembly provided with a pocket adapted to receive the closing plug from a hopper which houses in its inside a plurality of closing plugs, a support device of the syringe, and an actuating device for moving the pocket and the support device with respect to each other with a roto-translating movement about and along a longitudinal axis of the syringe so as to screw the closing plug onto the open end of the syringe itself.

10 Claims, 3 Drawing Sheets

(56) References Cited

U.S. PATENT DOCUMENTS 5,884,457 A * 3/1999 Ortiz ..... B65B 7/2835 53/167
6,341,472 B1 * 1/2002 Schroeder ..... B67B 3/003 53/306
6,430,896 B1 * 8/2002 Torikian ..... B65B 7/2835 53/310
6,804,929 B2 * 10/2004 Kemnitz ..... B65B 7/2828 53/317
2003/0041560 A1 3/2003 Kemnitz
2012/0110950 A1 * 5/2012 Schraudolph ..... B67B 3/2006 53/331.5

* cited by examiner

SCREWING ASSEMBLY FOR SCREWING CLOSING PLUGS ONTO SYRINGES

CROSS-REFERENCE TO RELATED APPLICATION

The present application is a continuation application claiming priority benefit to a co-pending, non-provisional patent application entitled "Screwing Assembly for Screwing Closing Plugs onto Syringes," which was filed on Jun. 22, 2012, and assigned Ser. No. 13/530,160. The entire content of the foregoing non-provisional application is incorporated herein by reference.

TECHNICAL FIELD

The present invention relates to a screwing assembly for screwing closing plugs onto syringes.

BACKGROUND OF THE INVENTION

In the injectable pharmaceutical product preparation, it is known to make a machine comprising at least one store for a plurality of containers (bags, syringes and bottles, in the case in point); at least one dosing station for the preparation of pharmaceutical product obtained by feeding into a syringe a pharmaceutical taken from a bottle and diluent taken from a bag; and a gripping and conveying device for transferring the containers between the store and the dosing station.

The syringe comprises a containment cylinder, a plunger engaged in sliding manner in the containment cylinder and a needle snap-locked onto an open end of the containment cylinder itself.

After having prepared the pharmaceutical product in the syringe, the needle is removed from the syringe and the open end is sealed by means of the closing plug in order to allow medical personnel to safely handle the syringe itself.

Because the closing plug is normally snap-locked on the open end of the syringe, the known machines for the preparation of pharmaceutical products of the type described above have some drawbacks mainly deriving from the fact that the closing plug and the syringe are moved against each other with a relatively high coupling force, which may damage both the closing plug and the open end of the containment cylinder, thus preventing the subsequent assembly of a new needle.

Furthermore, the known machines for the preparation of pharmaceutical products of the type described above do not allow the use of threaded closing plugs and thus have a relatively low flexibility of use.

SUMMARY OF THE INVENTION

It is the object of the present invention to provide a screwing assembly for screwing closing plugs on syringes which is free from the above-described drawbacks and which is simple and cost-effective to implement.

According to the present invention, a screwing assembly for screwing closing plugs onto syringes is provided as disclosed in the appended claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
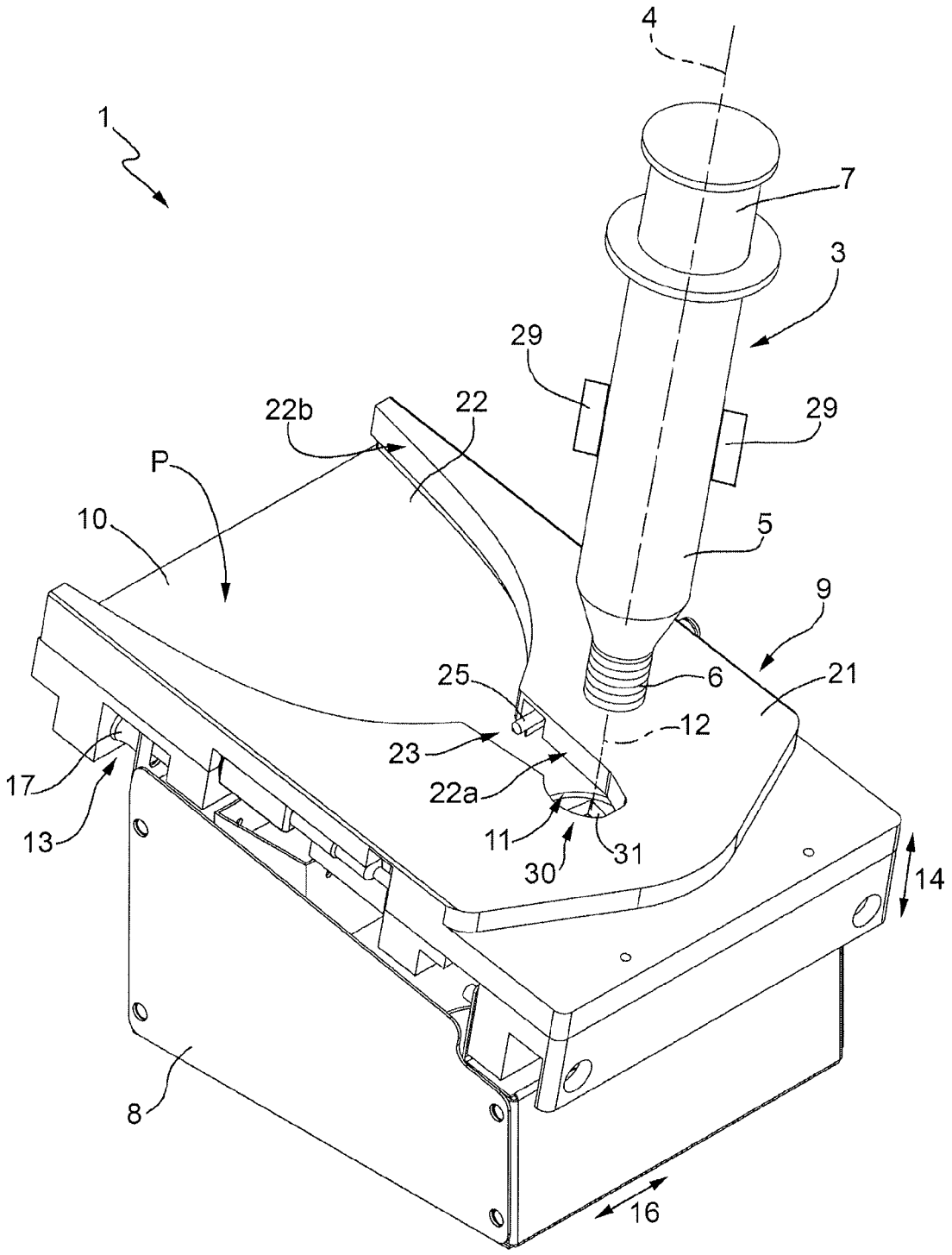
FIG. 1 is a perspective diagrammatic view, with parts removed for clarity, of a preferred embodiment of the screwing assembly of the present invention.
Figure 2:
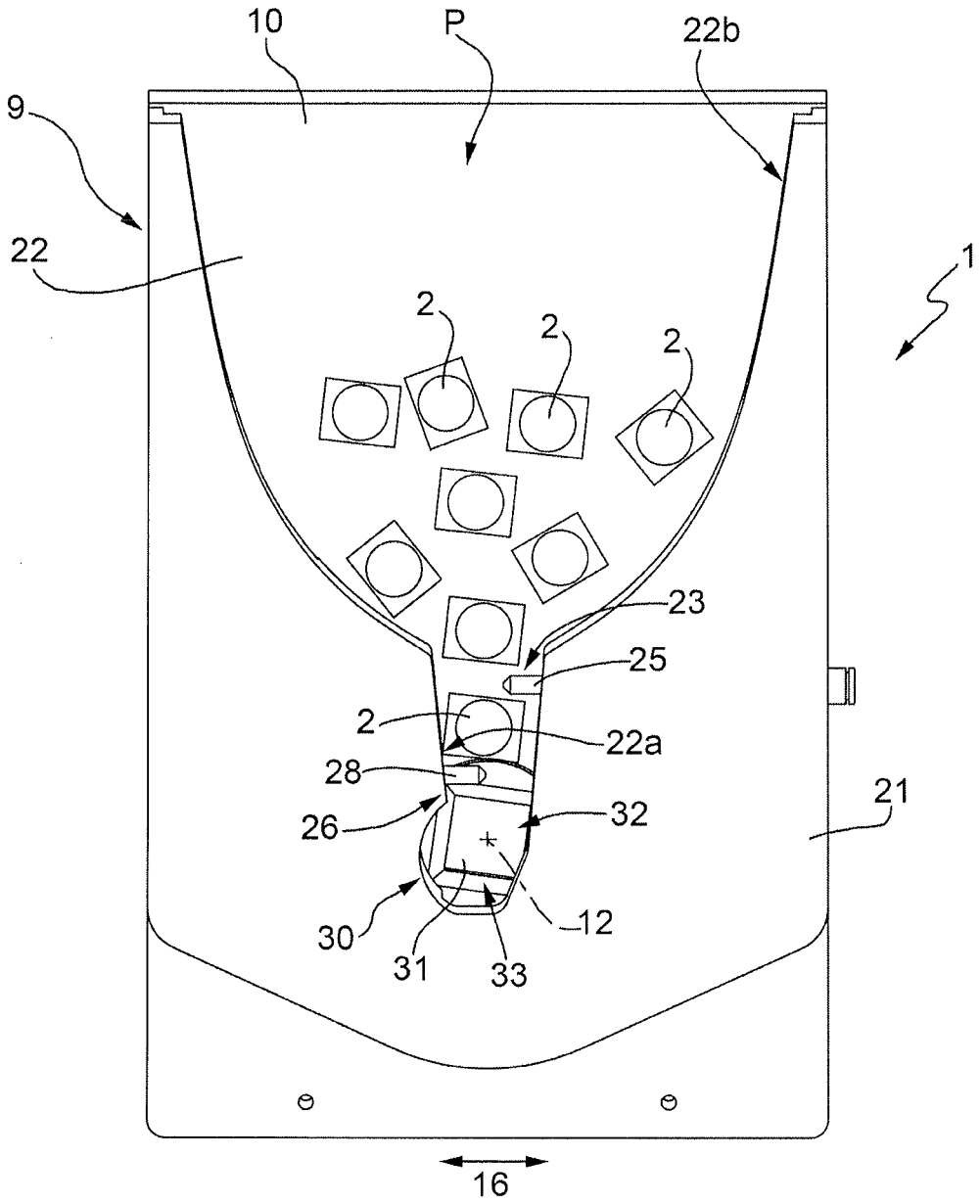
FIG. 2 is a diagrammatic plan view of a detail in FIG. 1.
Figure 3:
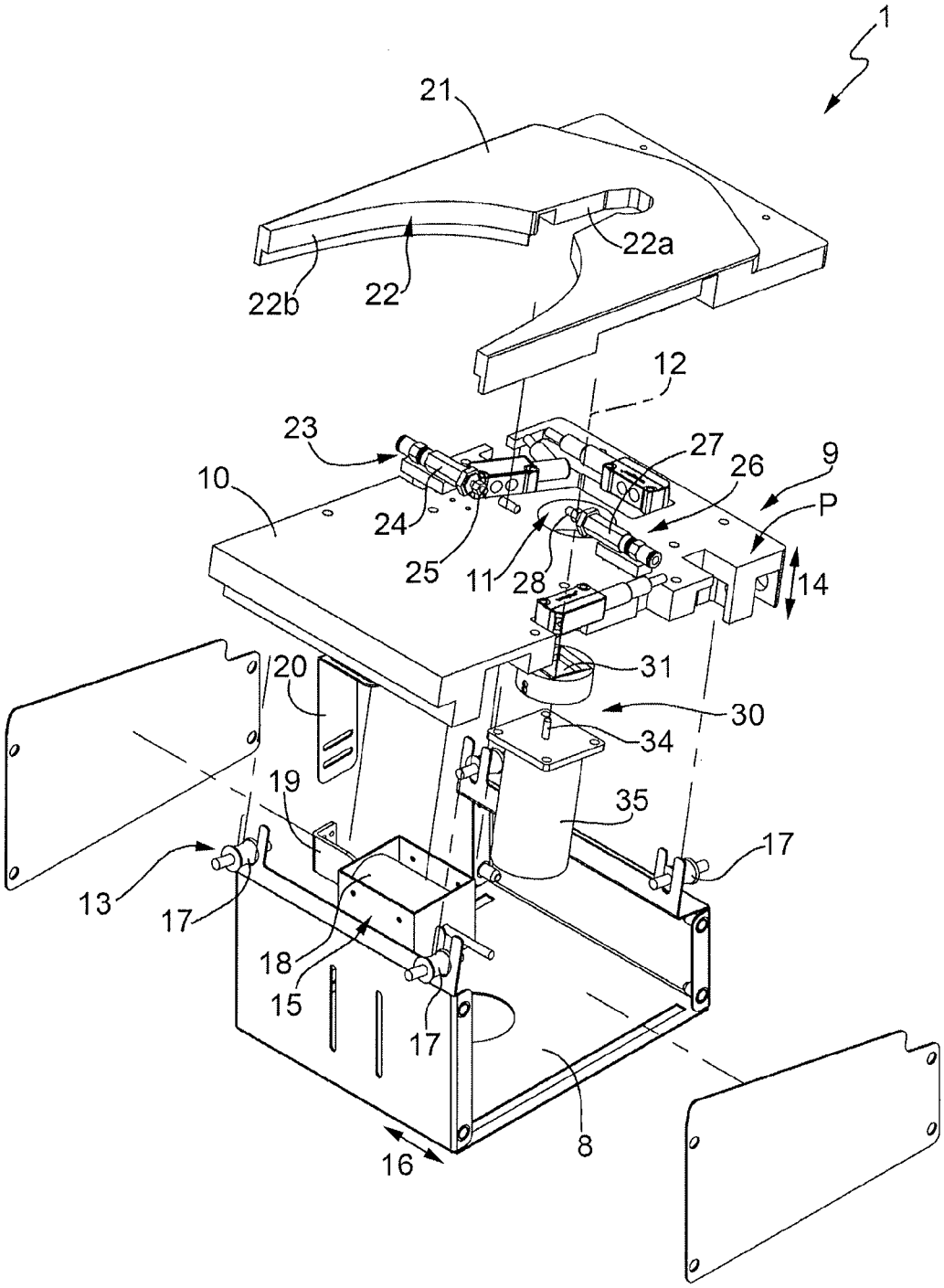
FIG. 3 is an exploded perspective view of the detail in FIG. 2.

With reference to FIGS. 1, 2, and 3, numeral 1 indicates as a whole a screwing assembly for screwing closing plugs 2 of substantially quadrilateral shape onto syringes 3 of known type, each of which has a given longitudinal axis 4 and comprises a containment cylinder 5, which is provided with an externally threaded open end 6, and is slidingly engaged by a plunger 7.

In the case in point, the plugs 2 are designed so as to be absolutely tamperproof during handling of the syringes 3 containing the pharmaceutical product to be administered to patients.

The screwing assembly 1 comprises a boxed frame 8 closed on the top by a containment hopper 9 for a plurality of plugs 2 arranged within the hopper 9 with their concavities facing upwards.

The hopper 9 comprises a vibrating plate 10, which has a substantially rectangular shape, defines a support plane P for the plugs 2 inclined according to a given angle with respect to a substantially horizontal reference plane, and has an outlet hole 11, which is obtained through a lower end of the plate 10, and has a longitudinal axis 12 substantially perpendicular to the plane P itself.

The plate 10 is slidingly coupled to the frame 8 with the interposition of a shock absorber device 13 to perform rectilinear movements in a direction 14 substantially parallel to axis 12 with respect to the frame 8, and is additionally coupled in sliding manner to the frame 8 to move with respect to the frame 8 and under the bias of an actuating device 15, with a reciprocating rectilinear motion in a substantially horizontal direction 16 transversal to direction 14.

Device 13 comprises, in the case in point, four elastic elements 17 mounted between frame 8 and plate 10 at the vertexes of the plate 10 itself; and the device 15 comprises an electromagnetic actuator 18, which is fixed within the frame 8 parallel to direction 16, and has an outlet rod 19 connected to a coupling bracket 20 protruding downwards from the plate 10.

The hopper 9 is limited on the side by a hollow plate 21, which is fork-shaped, is fixed onto the plate 10 to define an advancement channel 22 of the plugs 2 along the plane P and towards the hole 11, and is shaped so as to divide the channel 22 into a lower substantially rectilinear outlet section 22*a* connected to the hole 11 and an upper inlet section 22*b* converging towards section 22*a*.

Channel 22 cooperates with a first stop device 23 comprising an actuating cylinder 24, which is mounted inside the plate 21 parallel to direction 16, and has an output rod 25 mobile between a rest position, in which the rod 25 is substantially contained in the plate 21, and an operating position, in which the rod 25 protrudes into the section 22*a* to prevent the plugs 2 from reaching the inside of the section 22*a* itself.

The channel 22 further cooperates with a second stop device 26, comprising an actuating cylinder 27, which is mounted inside the plate 21 parallel to direction 16, and has an output rod 28 mobile between a rest position, in which the rod 28 is substantially contained in the plate 21, and an operating position, in which the rod 28 protrudes into the section 22*a* downstream of the rod 25 to prevent the plugs 2 from reaching the hole 11.

With regards to this, it is worth specifying that the movement of the rods 25 and 28 in their operating positions defines a compartment adapted to accommodate a single plug 2 therein.

The screwing assembly 1 further comprises a support device 29 of a syringe 3, e.g. a robotized arm, adapted to keep the syringe 3 in position coaxial to the axis 12, and a support device 30 adapted to receive the plug 2 fed each time through the hole 11.

The device 30 comprises a pocket 31, which is mounted inside the frame 8, under the plate 10, and in position facing the hole 11, is limited by a bottom wall 32, which has a quadrilateral shape substantially corresponding to the shape of the plugs 2, and which extends perpendicular to direction 14, and is further limited by a quadrilateral side wall 33, which extends about axis 12, and is inclined according to an angle other than 90° with respect to the wall 32 itself.

The pocket 31 is mounted on the free end of the outlet shaft 34 of an electric motor 35, which is mounted within the frame 8 parallel to direction 14, is fixed to the hopper 9 under the plate 10, is adapted to rotate the pocket 31, with respect to the plate 10 itself, about axis 12, and is torque-controlled so as to allow the correct screwing of the plugs 2 onto the respective syringes 3.

The shape of the pocket 31 and of the lower outlet section 22*a* of the channel 22 allows the plugs 2 to drop through the hole 11 so as to be aligned with, and correctly inserted in the pocket 31 itself during the rotation about the axis 12.

The operation of screwing assembly 1 will now be described with reference to FIGS. 1, 2 and 3 starting from an instant in which:

the syringe 3 is moved by the device 29 to a position coaxial to axis 12;

the stop devices 23, 26 are arranged in their operating positions; and the outlet section 22*a* of the channel 22 is empty.

Device 23 is firstly moved to its rest position to allow a plug 2 to drop into the section 22*a* and is then moved again to its operating position to prevent other plugs 2 from dropping into the section 22*a* itself.

The device 26 is thus moved to the rest position thereof to allow the considered plug 2 to reach the hole 11 and fall into the pocket 31.

At this point, the syringe 3 is lowered by the device 29 so as to allow the open end 6 of the syringe 3 to engage the plug 2 and to move the assembly defined by the hopper 9 and by the pocket 31 against the bias of the elastic elements 17 of the shock absorbers device 13.

Finally, the pocket 31 and thus the plug 2 are rotated about the axis 12 by the actuation of the electric motor 35 and translated along the axis 12 by the bias of the elastic element 17 of the shock absorber device 13. In other words, the pocket 31 and the plug 2 are moved with roto-translating movement about and along the mentioned axis 12 in order to screw the plug 2 onto the open end 6 of the syringe 3.

With regards to the above, it is worth noting that the pharmaceutical product contained in the syringe 3 does not exit from the end 6 due to the surface tension and the capillarity of the cylinder 5 at the open end 6 itself.

What is claimed is:

1. Screwing assembly for screwing closing plugs onto syringes, each syringe presenting a longitudinal axis and comprising a cylinder provided with a threaded open end and a plunger engaged in a sliding manner in the cylinder itself;

the screwing assembly being characterized in that it includes:

a fixed support frame closed on a top end by a hopper, the hopper housing in its inside a plurality of closing plugs, the hopper including a plate having an outlet for the closing plugs from the hopper itself;

a pocket mounted on a bottom surface of the plate, positioned under the plate, and arranged inside the fixed support frame, the pocket suited to receive and hold the closing plug fed each time through said outlet;

a support device for supporting the syringe;

actuating means for moving the pocket and the support device with respect to one another with a roto-translating movement around and along said longitudinal axis, so as to screw the closing plug onto said open end; and a shock absorber device positioned under the plate and interposed between the plate and the support frame, so as to allow the pocket to move with respect to the syringe parallel to said longitudinal axis while the pocket remains positioned under the plate, and while the closing plug is being screwed onto the open end of the syringe itself while the pocket remains positioned under the plate.

2. Screwing assembly according to claim 1 and comprising, furthermore, a first stop device, which is mobile inside the hopper from and to an operating position, in which the first stop device prevents a first closing plug from reaching said outlet.

3. Screwing assembly according to claim 2 and comprising, furthermore, a second stop device, which is arranged behind the first stop device, and is mobile inside the hopper from and to an operating position, in which the second stop device is arranged so as to separate the first closing plug from the remaining closing plugs contained in the hopper.

4. Screwing assembly according to claim 1, wherein the plate comprises a vibrating plate defining a support plane, which is inclined with respect to a horizontal reference plane.

5. Screwing assembly according to claim 4, wherein the hopper is delimited by a lateral wall defining a conveying channel of the closing plugs along the vibrating plate; the conveying channel comprising an outlet section connected to said outlet and an inlet section converging towards the outlet section itself.

6. Screwing assembly according to claim 5 and comprising, furthermore, a first stop device, which is mobile inside the hopper from and to an operating position, in which the first stop device prevents the closing plugs from being transferred from the outlet section to said outlet, and a second stop device, which is mobile inside the hopper from and to an operating position, in which the second stop device prevents the closing plugs from being transferred from the inlet section to the outlet section.

7. Screwing assembly according to claim 1 and comprising, furthermore, an electric motor for moving the pocket around said longitudinal axis.

8. Screwing assembly according to claim 1, wherein the pocket is delimited by a bottom wall, which is perpendicular to said longitudinal axis, and by a lateral wall, which is inclined with respect to the bottom wall itself at an angle different from 90°.

9. Screwing assembly according to claim 8, wherein the lateral wall of the pocket presents a quadrilateral shape.

10. Screwing assembly according to claim 1, wherein the plate includes four vertices; and wherein the shock absorber device includes four elastic elements, each elastic element mounted between the support frame and the plate at a respective vertex of the plate.

* * * * *